US009874163B1

(12) United States Patent
Hakeem et al.

(10) Patent No.: US 9,874,163 B1
(45) Date of Patent: Jan. 23, 2018

(54) METHODS AND SYSTEM FOR ADJUSTING ENGINE OPERATION BASED ON EVAPORATED AND CONDENSED PORTIONS OF WATER INJECTED AT AN ENGINE

(71) Applicant: Ford Global Technologies, LLC, Dearborn, MI (US)

(72) Inventors: Mohannad Hakeem, Dearborn, MI (US); Gopichandra Surnilla, West Bloomfield, MI (US); Stephen B. Smith, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 16 days.

(21) Appl. No.: 15/226,485

(22) Filed: Aug. 2, 2016

(51) Int. Cl.

| | |
|---|---|
| ***F02B 47/02*** | (2006.01) |
| ***F02D 41/00*** | (2006.01) |
| ***F02D 19/12*** | (2006.01) |
| ***F02D 41/26*** | (2006.01) |
| ***F02M 35/104*** | (2006.01) |
| ***F02M 35/10*** | (2006.01) |

(52) U.S. Cl.
CPC ..... *F02D 41/0025* (2013.01); *F02B 47/02* (2013.01); *F02D 19/12* (2013.01); *F02D 41/26* (2013.01); *F02M 35/104* (2013.01); *F02M 35/10393* (2013.01)

(58) Field of Classification Search
CPC ..... F02D 41/0025; F02D 41/26; F02D 19/12; F02M 35/10393; F02M 35/104; F02M 2700/4321; F02M 25/025; F02M 25/028; F02M 25/032; F02M 25/035; F02M 25/14; F02B 47/02
USPC ..... 123/1 A, 25 A, 198 A
See application file for complete search history.

(56) References Cited

U.S. PATENT DOCUMENTS 4,125,092 A 11/1978 Inamura
4,141,323 A * 2/1979 Hart ..... F02M 25/035 123/25 B (Continued)

FOREIGN PATENT DOCUMENTS

DE 10204181 C1 10/2003
DE 102012207904 A1 11/2013
EP 2607647 A1 6/2013

OTHER PUBLICATIONS

Bohm, Martin, et al., "Approaches for On-board Water Provision for Water Injection," Alternative Propulsion, MTZ, vol. 118, pp. 54-57, 2016, 4 pages.

(Continued)

*Primary Examiner* — Hai Huynh
(74) *Attorney, Agent, or Firm* — Julia Voutyras; McCoy Russell LLP

(57) ABSTRACT

Methods and systems are provided for adjusting engine operation based on estimated vaporized and condensed portions of water injected during a water injection event. In one example, a method may include injecting an amount of water into the intake manifold in response to engine conditions and inferring vaporized and condensed portions of the injected water based on the injected amount and a change in manifold temperature following the injection. Further, the method may include adjusting water injection and engine operating parameters in response the evaporated and/or condensed portion of water.

20 Claims, 8 Drawing Sheets

(56) References Cited

U.S. PATENT DOCUMENTS

| | | | | |
|---|---|---|---|---|
| 4,279,223 | A * | 7/1981 | Csonka | F02M 25/028 123/25 C |
| 4,461,245 | A | 7/1984 | Vinokur | |
| 4,519,341 | A | 5/1985 | McGarr | |
| 4,558,665 | A | 12/1985 | Sandberg et al. | |
| 4,571,157 | A | 2/1986 | Eickmann | |
| 4,790,277 | A | 12/1988 | Schechter | |
| 5,148,776 | A | 9/1992 | Connor | |
| 5,199,386 | A | 4/1993 | Hubbard | |
| 5,937,799 | A | 8/1999 | Binion | |
| 6,026,641 | A | 2/2000 | Liberty | |
| 6,289,853 | B1 | 9/2001 | Walczak et al. | |
| 7,216,607 | B2 * | 5/2007 | Mezheritsky | F02B 47/02 123/198 D |
| 7,530,349 | B2 * | 5/2009 | Rim | F01N 5/02 123/568.15 |
| 7,533,651 | B2 | 5/2009 | Surnilla | |
| 7,549,408 | B2 | 6/2009 | Russell | |
| 7,823,563 | B2 | 11/2010 | Jankovic et al. | |
| 8,096,283 | B2 | 1/2012 | Surnilla et al. | |
| 8,127,745 | B2 | 3/2012 | Surnilla et al. | |
| 8,267,066 | B2 | 9/2012 | Surnilla et al. | |
| 8,352,162 | B2 | 1/2013 | Leone et al. | |
| 8,387,591 | B2 | 3/2013 | Surnilla et al. | |
| 8,434,431 | B2 | 5/2013 | Fried et al. | |
| 8,483,937 | B2 | 7/2013 | Surnilla et al. | |
| 8,522,749 | B2 | 9/2013 | Surnilla et al. | |
| 8,522,760 | B2 | 9/2013 | Soltis | |
| 8,554,445 | B2 | 10/2013 | Leone | |
| 8,701,630 | B2 | 4/2014 | Surnilla et al. | |
| 8,755,989 | B2 | 6/2014 | Surnilla et al. | |
| 8,763,594 | B2 | 7/2014 | Surnilla et al. | |
| 8,904,973 | B2 * | 12/2014 | Pendray | F01B 1/12 123/25 A |
| 8,960,133 | B2 | 2/2015 | Leone et al. | |
| 9,016,244 | B2 | 4/2015 | Leone et al. | |
| 9,127,607 | B2 | 9/2015 | Glugla et al. | |
| 9,145,823 | B2 | 9/2015 | Glugla et al. | |
| 9,169,755 | B2 | 10/2015 | Ulrey et al. | |
| 9,212,627 | B2 | 12/2015 | Fulton et al. | |
| 9,291,125 | B2 | 3/2016 | Yoshihara et al. | |
| 2008/0283100 | A1 | 11/2008 | Ogasawara et al. | |
| 2010/0121559 | A1 | 5/2010 | Bromberg et al. | |
| 2011/0174267 | A1 | 7/2011 | Surnilla et al. | |
| 2013/0118165 | A1 | 5/2013 | Leone et al. | |
| 2013/0206100 | A1 | 8/2013 | Yacoub | |
| 2013/0218438 | A1 | 8/2013 | Surnilla et al. | |
| 2014/0031012 | A1 | 1/2014 | Park et al. | |
| 2014/0034013 | A1 | 2/2014 | Leone | |
| 2014/0352663 | A1 | 12/2014 | Glugla et al. | |
| 2014/0366508 | A1 | 12/2014 | Ulrey et al. | |
| 2015/0136068 | A1 | 5/2015 | Leone et al. | |
| 2015/0147949 | A1 | 5/2015 | Macfarlane et al. | |

OTHER PUBLICATIONS

Bohm, Martin, et al., "Functional Integration of Water Injection into the Gasoline Engine," Development Injection, MTZ, vol. 77, pp. 36-41, 2016, 6 pages.

Hakeem, Mohannad, et al., "Method and System for Determining Knock Control Fluid Composition," U.S. Appl. No. 14/918,475, filed Oct. 20, 2015, 58 pages.

Miller, Kenneth James, et al., "Methods and Systems for Adjusting Vehicle Grille Shutters Based on Engine Operation," U.S. Appl. No. 14/742,335, filed Jun. 17, 2015, 41 pages.

Hakeem, Mohannad, et al., "Methods and System for Selecting a Location for Water Injection in an Engine," U.S. Appl. No. 15/226,548, filed Aug. 2, 2016, 52 pages.

Hakeem, Mohannad, et al., "Methods and System for Injecting Water at Different Groups of Cylinders of an Engine," U.S. Appl. No. 15/226,615, filed Aug. 2, 2016, 54 pages.

Shelby, Michael Howard, et al., "Method and System for Engine Water Injection," U.S. Appl. No. 15/384,243, filed Dec. 19, 2016, 55 pages.

* cited by examiner

METHODS AND SYSTEM FOR ADJUSTING ENGINE OPERATION BASED ON EVAPORATED AND CONDENSED PORTIONS OF WATER INJECTED AT AN ENGINE

FIELD

The present description relates generally to methods and systems for injecting water at an engine and adjusting engine operation based on the water injection.

BACKGROUND/SUMMARY

Internal combustion engines may include water injection systems that inject water into a plurality of locations, including an intake manifold, upstream of engine cylinders, or directly into engine cylinders. Injecting water into the engine intake air may increase fuel economy and engine performance, as well as decrease engine emissions. When water is injected into the engine intake or cylinders, heat is transferred from the intake air and/or engine components to the water. This heat transfer leads to evaporation, which results in cooling. Injecting water into the intake air (e.g., in the intake manifold) lowers both the intake air temperature and a temperature of combustion at the engine cylinders. By cooling the intake air charge, a knock tendency may be decreased without enriching the combustion air-fuel ratio. This may also allow for a higher compression ratio, advanced ignition timing, and decreased exhaust temperature. As a result, fuel efficiency is increased. Additionally, greater volumetric efficiency may lead to increased torque. Furthermore, lowered combustion temperature with water injection may reduce NOx, while a more efficient fuel mixture may reduce carbon monoxide and hydrocarbon emissions. As explained above, water may be injected into different locations, including the intake manifold, intake ports of engine cylinders, or directly into engine cylinders. While direct and port injection may provide increased cooling to the engine cylinders and ports, intake manifold injection may increase cooling of the charge air without needing high pressure injectors and pumps. However, due to the lower temperature of the intake manifold, not all the water injected at the intake manifold atomizes properly. Condensed water from water injection may accumulate within the intake manifold and result in unstable combustion if ingested by the engine. Additionally, manifold water injection may result in uneven water distribution amongst cylinders coupled to the manifold. As a result, uneven cooling may be provided to the engine cylinders.

Other approaches to reduce condensate formation in the intake manifold during water injection include limiting the amount of water injected based on manifold temperature. For example, the approach shown by Yacoub in U.S. publication No. 2013/0206100 determines the amount of water to be injected as a function of measured manifold temperature. However, the inventors have recognized potential issues with such methods. In particular, adjusting water injection amounts based on manifold temperature alone may not sufficiently reduce condensation and water accumulation in the intake manifold. Further, there is no way to compensate for water that condenses within the intake manifold. As a result, unstable combustion may result from water ingested by the engine.

In one example, the issues described above may be addressed by a method for injecting an amount of water into an intake manifold of an engine responsive to engine conditions and adjusting an engine operating parameter responsive to a first portion of the amount of water that vaporized and second portion of the amount of water that remained liquid. In this way, engine operation may be adjusted to compensate for the first and second portions, thereby decreasing the likelihood of unstable combustion due to condensed liquid in the intake manifold and increasing the fuel economy and engine performance benefits of water injection.

As one example, the first portion of the amount of water that vaporized may be determined based on a change in manifold temperature following the injecting and the second portion of the amount of water that remained liquid may be determined based on the injected amount of water and the first portion. Further, engine operating parameters such as spark timing may be adjusted in response to the first and second portions. In this way, spark timing adjustments may compensate for the condensed water resulting from water injection and therefore reduce the likelihood of unstable combustion due to ingesting the condensed water. In another example, water injection amounts for subsequent water injection events may be adjusted based on the first and/or second portions. This may result in achieving desired water injection amounts in the intake manifold and therefore further increase fuel economy, decrease knock, and decrease emissions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
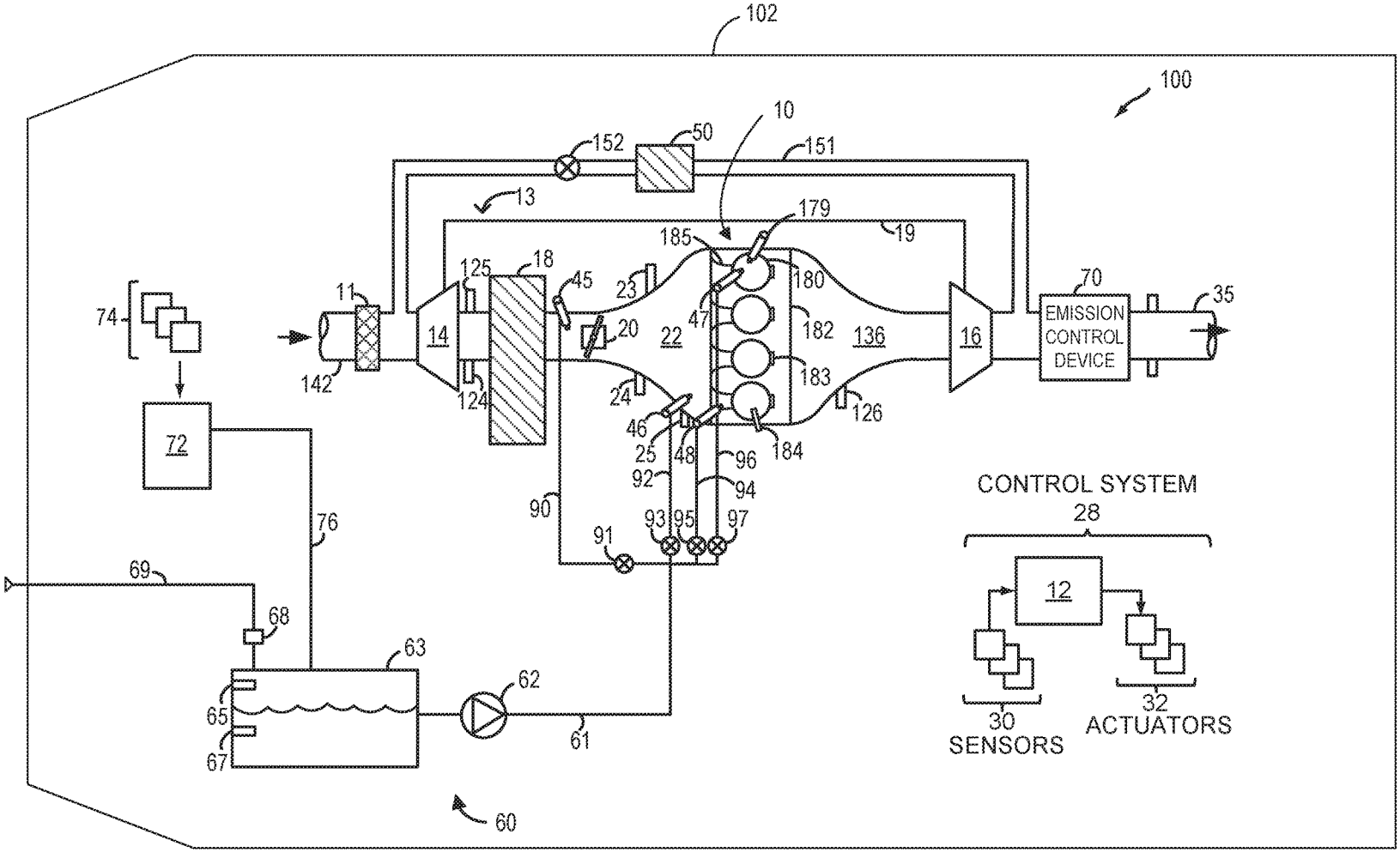
FIG. 1 shows a schematic diagram of an engine system including a water injection system.
Figure 2:
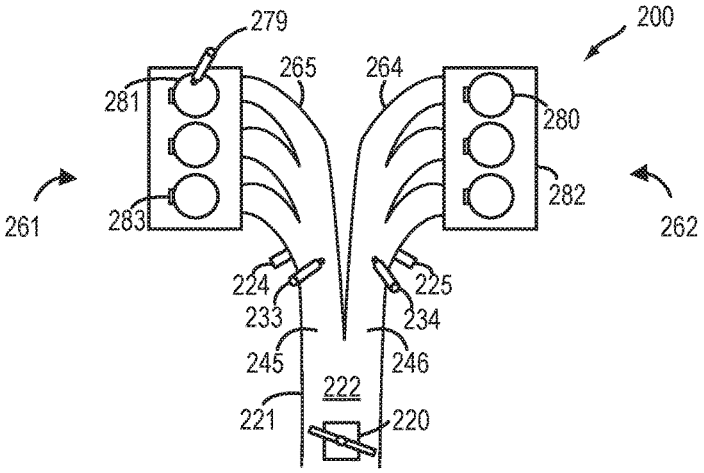
FIG. 2 shows a schematic diagram of a first embodiment of a water injector arrangement for an engine.
Figure 3:
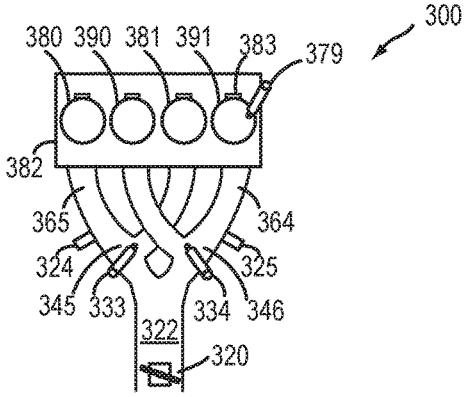
FIG. 3 shows a schematic diagram of a second embodiment of a water injector arrangement for an engine.
Figure 4:
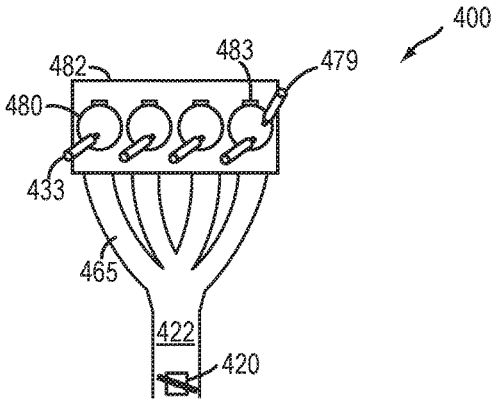
FIG. 4 shows a schematic diagram of a third embodiment of a water injector arrangement for an engine.
Figure 5:
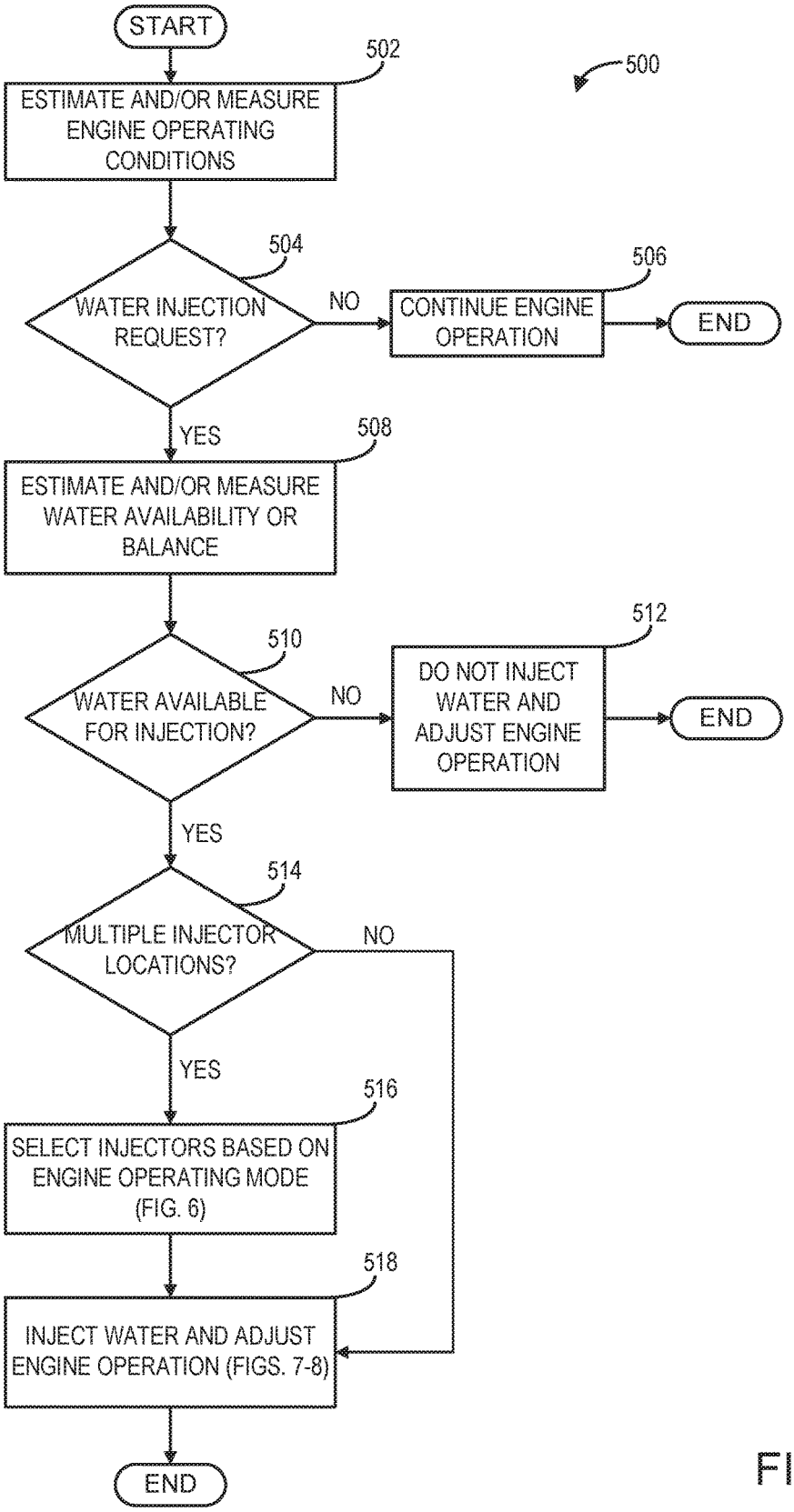
FIG. 5 shows a flow chart of a method for injecting water into one or more locations in an engine.
Figure 6:
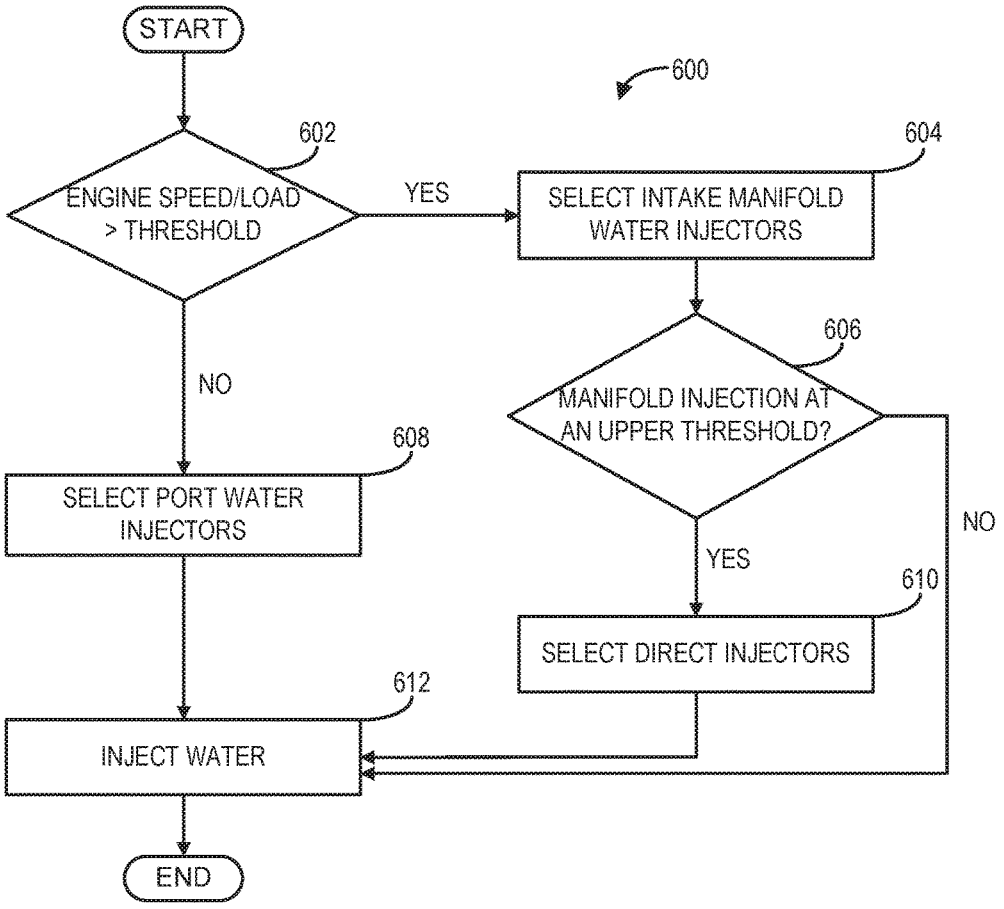
FIG. 6 shows a flow chart of a method for selecting a location for water injection based on engine operating parameters.
Figure 7:
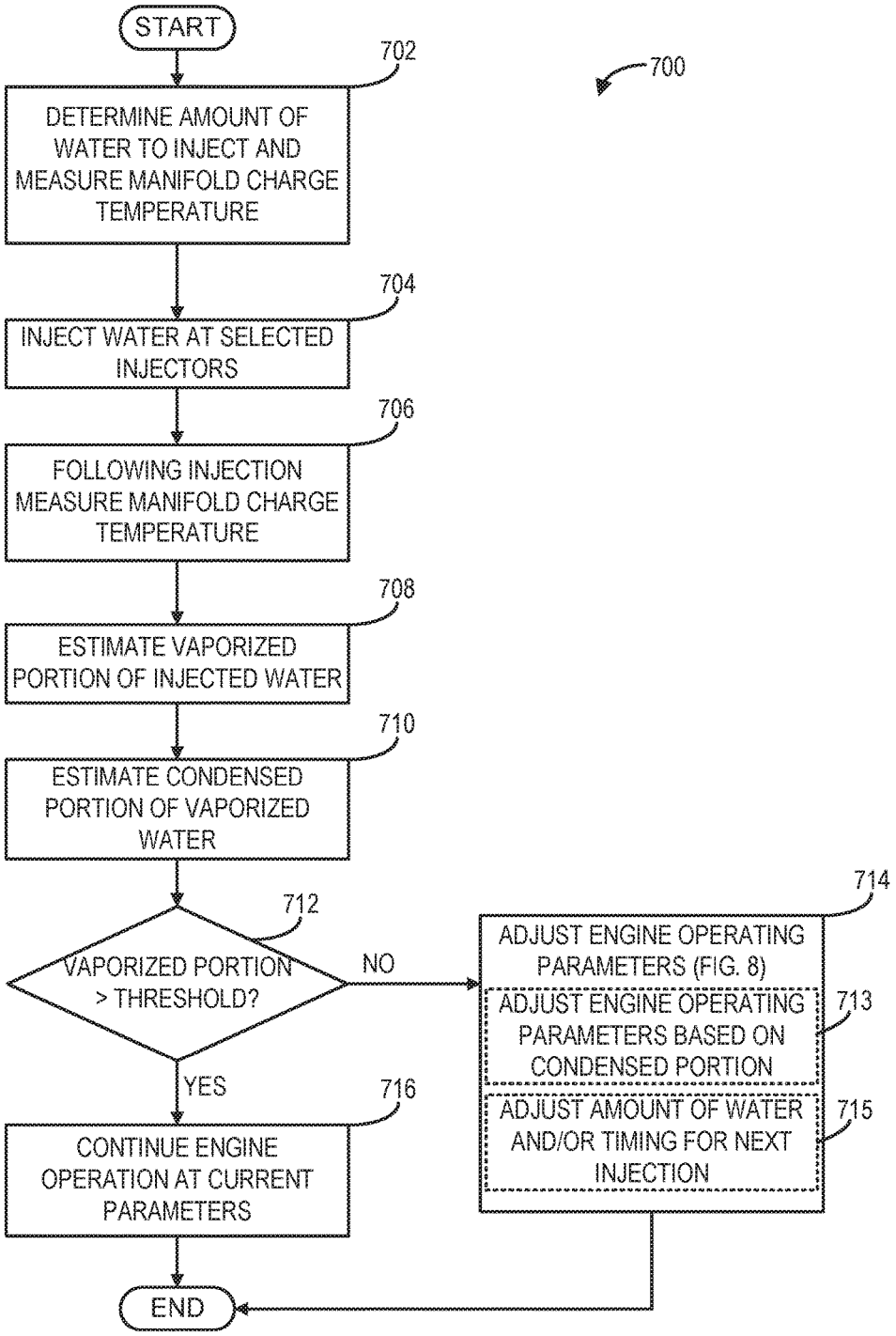
FIG. 7 shows a flow chart of a method for adjusting water injection and engine operating parameters based on estimated vaporized and condensed portions of water injected at an engine.
Figure 8:
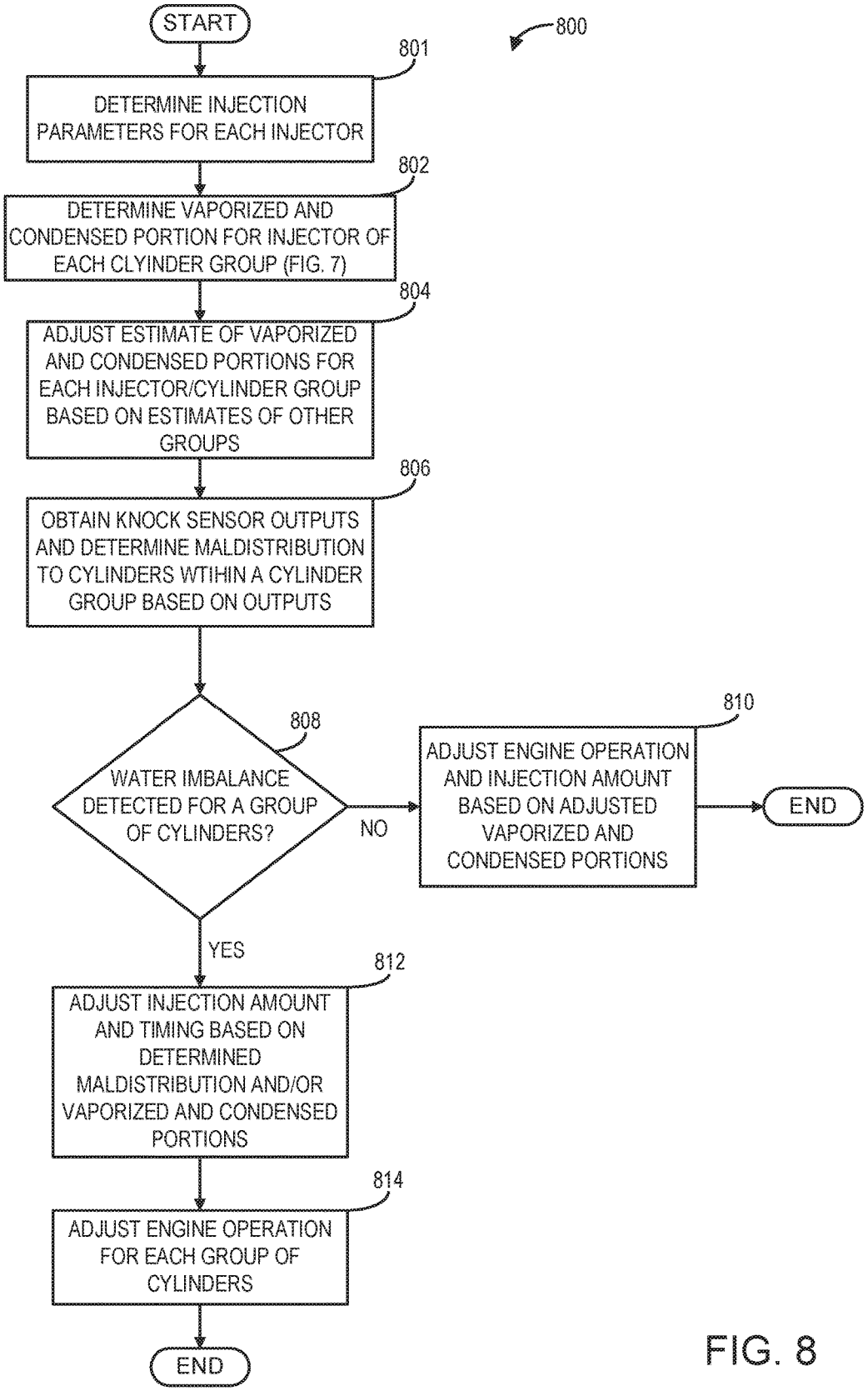
FIG. 8 shows a flow chart of a method for adjusting water injection to a group of cylinders of an engine and adjusting water injection parameters based on a distribution of water injected upstream of a group of cylinders.
Figure 9:
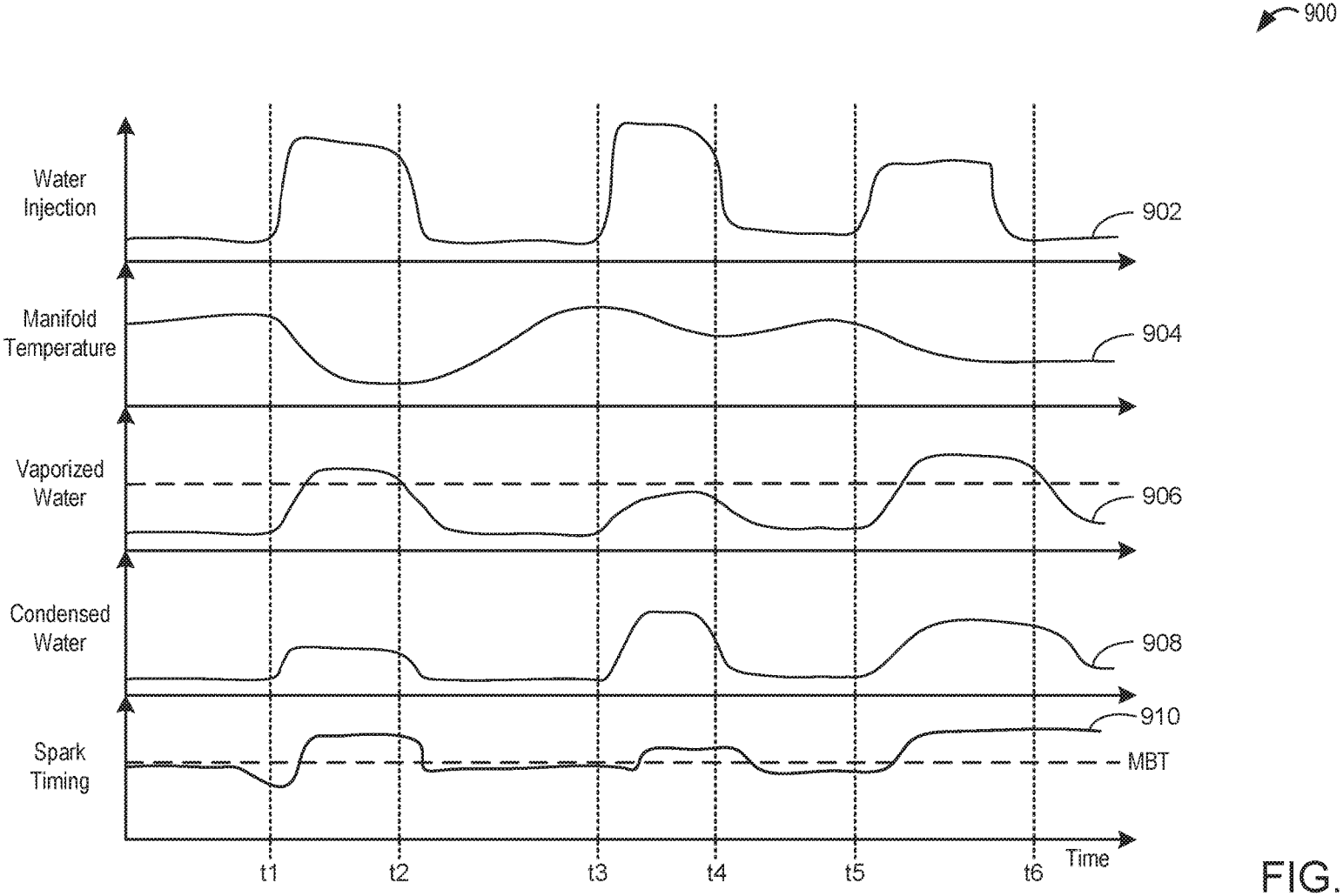
FIG. 9 shows a graph depicting adjustments to various engine operating conditions in response to estimated vaporized and condensed portions of water injected at an engine.

The following description relates to systems and methods for injecting water at a selected location in an engine based on engine operating conditions of the engine and adjusting water injection parameters, as well as engine operating parameters, based on one or more of an estimated portion of water that condensed following injection, an estimated portion of water that evaporated following injection, and detected imbalances in water distribution from injection among a group of cylinders. A schematic depiction of an example vehicle system, including a water injection system, is shown in FIG. 1. FIGS. 2-4 show alternate embodiments of an engine with example locations of water injectors for substantially the same engine system as the one shown in FIG. 1. Water injectors may be located in a manifold, upstream of multiple cylinders, in intake ports of the engine cylinders, and/or at each individual cylinder. During engine operation, water injection at selected locations may be requested depending on various operating conditions of the engine in order to increase charge air cooling, increase cooling to engine components, and/or increase dilution at the engine cylinders. Conditions influencing the amount of water to be injected may include engine load, spark timing, knock intensity, etc. FIGS. 5-8 illustrate example methods for injecting water at various locations in the engine (e.g., such as an intake manifold or intake ports of cylinders) and subsequently adjusting engine operating parameters based on estimates of vaporized and condensed portions of the injected water. Specifically, FIG. 5 shows a method for determining whether to inject water via one or more water injectors based on engine operating conditions. In FIG. 6, a method is shown for selecting water injection at different engine locations based on engine operating conditions. For example, water may be injected via one or more injectors disposed in a manifold (such as an intake manifold) upstream of a plurality of cylinders, in an intake port of individual cylinders, and/or directly into engine cylinders. FIG. 7 shows a method for injecting water at the selected location and estimating the amount of water that evaporated and condensed following the injection. Additionally, FIG. 7 shows a method for adjusting the amount of water injected during subsequent injection events and adjusting engine operating conditions based on these estimated amounts. For example, spark timing may be adjusted to compensate for greater amounts of injected water that condensed (e.g., remained liquid). In some examples, water may be injected upstream of a group (e.g., two or more) cylinders). However, due to different airflow amounts, pressures, and architectures of each cylinder, injected water may not be distributed evenly to all cylinders of the group. Thus, as shown in FIG. 8, a method may include detecting an imbalance in water distribution across cylinders in a group based on output from knock sensors and adjusting water injection parameters based on the detected imbalance. In this way, more even water distribution may be achieved among cylinders. FIG. 9 graphically depicts changes to various engine operating parameters in response to estimated vaporized and condensed portions of water injected at the selected locations. Finally, FIG. 10 graphically depicts adjusting the amount and timing of water injection pulses in response to uneven distribution across cylinders. In this way, water injection parameters may be selected based on estimates of how much of the injected water is vaporizing vs. condensing at the selected location, how much of the injected water is going to each cylinder, and engine operating conditions. As a result, desired charge air cooling and engine dilution may be provided to all engine cylinders. This may increase engine efficiency, decrease fuel consumption, and decrease emissions of the engine.

FIG. 1 shows an embodiment of a water injection system 60 and an engine system 100, in a motor vehicle 102, illustrated schematically. In the depicted embodiment, engine 10 is a boosted engine coupled to a turbocharger 13 including a compressor 14 driven by a turbine 16. Specifically, fresh air is introduced along intake passage 142 into engine 10 via air cleaner 11 and flows to compressor 14. The compressor may be a suitable intake-air compressor, such as a motor-driven or driveshaft driven supercharger compressor. In the engine system 100, the compressor is shown as a turbocharger compressor mechanically coupled to turbine 16 via a shaft 19, the turbine 16 driven by expanding engine exhaust. In one embodiment, the compressor and turbine may be coupled within a twin scroll turbocharger. In another embodiment, the turbocharger may be a variable geometry turbocharger (VGT), where turbine geometry is actively varied as a function of engine speed and other operating conditions.

As shown in FIG. 1, compressor 14 is coupled, through charge air cooler (CAC) 18 to throttle valve (e.g., intake throttle) 20. The CAC may be an air-to-air or air-to-coolant heat exchanger, for example. Throttle valve 20 is coupled to engine intake manifold 22. From the compressor 14, the hot compressed air charge enters the inlet of the CAC 18, cools as it travels through the CAC, and then exits to pass through the throttle valve 20 to the intake manifold 22. In the embodiment shown in FIG. 1, the pressure of the air charge within the intake manifold is sensed by manifold air pressure (MAP) sensor 24 and a boost pressure is sensed by boost pressure sensor 124. A compressor by-pass valve (not shown) may be coupled in series between the inlet and the outlet of compressor 14. The compressor by-pass valve may be a normally closed valve configured to open under selected operating conditions to relieve excess boost pressure. For example, the compressor by-pass valve may be opened during conditions of decreasing engine speed to avert compressor surge.

Intake manifold 22 is coupled to a series of combustion chambers or cylinders 180 through a series of intake valves (not shown) and intake runners (e.g., intake ports) 185. As shown in FIG. 1, the intake manifold 22 is arranged upstream of all combustion chambers 180 of engine 10. Sensors such as manifold charge temperature (MCT) sensor 23 and air charge temperature sensor (ACT) 125 may be included to determine the temperature of intake air at the respective locations in the intake passage. In some examples, the MCT and the ACT sensors may be thermistors and the output of the thermistors may be used to determine the intake air temperature in the passage 142. The MCT sensor 23 may be positioned between the throttle 20 and the intake valves of the combustion chambers 180. The ACT sensor 125 may be located upstream of the CAC 18 as shown, however, in alternate embodiments, the ACT sensor 125 may be positioned upstream of compressor 14. The air temperature may be further used in conjunction with an engine coolant temperature to compute the amount of fuel that is delivered to the engine, for example. Additional temperature sensors such as temperature sensor 25 may be included to determine the temperature proximate to a water injector. In some embodiments, an engine system 100 may include a plurality of temperature sensors 25 to determine the temperature at each water injector location in the engine 100. Each combustion chamber may further include a knock sensor 183 for identifying abnormal combustion events. Further, as explained further below with reference to FIG. 8, outputs of the knock sensors of each combustion chamber 180 may be used to detect maldistribution of water to each combustion chamber 180, where the water is injected upstream of all the combustion chambers 180. In alternate embodiments, one or more knock sensors 183 may be coupled to selected locations of the engine block.

The combustion chambers are further coupled to exhaust manifold 136 via a series of exhaust valves (not shown). The combustion chambers 180 are capped by cylinder head 182 and coupled to fuel injectors 179 (while only one fuel injector is shown in FIG. 1, each combustion chamber includes a fuel injector coupled thereto). Fuel may be delivered to fuel injector 179 by a fuel system (not shown) including a fuel tank, a fuel pump, and a fuel rail. Furthermore, combustion chamber 180 draws in water and/or water vapor, which may be injected into the engine intake or the combustion chambers 180 themselves by a plurality of water injectors 45-48. In the depicted embodiment, the water injection system is configured to inject water upstream of the throttle 20 via water injector 45, downstream of the throttle and into the intake manifold 22 via injector 46, into one or more intake runners (e.g., ports) 185*s* via injector 48, and directly into one or more combustion chambers 180 via injector 47. In one embodiment, injector 48 arranged in the intake runners may be angled toward and facing the intake valve of the cylinder which the intake runner is attached to. As a result, injector 48 may inject water directly onto the intake valve (this may result in fast evaporation of the injected water and increase the dilution benefit of using the water vapor as EGR to reduce pumping losses). In another embodiment, injector 48 may be angled away from the intake valve and be arranged to inject water against the intake air flow direction through the intake runner. As a result, more of the injected water may be entrained into the air stream, thereby increasing the cooling benefit.

Though only one representative injector 47 and injector 48 are shown in FIG. 1, each combustion chamber 180 and intake runner 185 may include its own injector. In alternate embodiments, a water injection system may include water injectors positioned at one or more of these positions. For example, an engine may include only water injector 46, in one embodiment. In another embodiment, an engine may include each of water injector 46, water injectors 48 (one at each intake runner), and water injectors 47 (one at each combustion chamber). Water may be delivered to water injectors 45-48 by the water injection system 60, as described further below.

In the depicted embodiment, a single exhaust manifold 136 is shown. However, in other embodiments, the exhaust manifold may include a plurality of exhaust manifold sections. Configurations having a plurality of exhaust manifold sections may enable effluent from different combustion chambers to be directed to different locations in the engine system. Universal Exhaust Gas Oxygen (UEGO) sensor 126 is shown coupled to exhaust manifold 136 upstream of turbine 16. Alternatively, a two-state exhaust gas oxygen sensor may be substituted for UEGO sensor 126.

As shown in FIG. 1, exhaust from the one or more exhaust manifold sections is directed to turbine 16 to drive the turbine. When reduced turbine torque is desired, some exhaust may be directed instead through a waste gate (not shown), by-passing the turbine. The combined flow from the turbine and the waste gate then flows through emission control device 70. In general, one or more emission control devices 70 may include one or more exhaust after-treatment catalysts configured to catalytically treat the exhaust flow, and thereby reduce an amount of one or more substances in the exhaust flow.

All or part of the treated exhaust from emission control device 70 may be released into the atmosphere via exhaust conduit 35. Depending on operating conditions, however, some exhaust may be diverted instead to an exhaust gas recirculation (EGR) passage 151, through EGR cooler 50 and EGR valve 152, to the inlet of compressor 14. In this manner, the compressor is configured to admit exhaust tapped from downstream of turbine 16. The EGR valve 152 may be opened to admit a controlled amount of cooled exhaust gas to the compressor inlet for desirable combustion and emissions-control performance. In this way, engine system 100 is adapted to provide external, low-pressure (LP) EGR. The rotation of the compressor, in addition to the relatively long LP EGR flow path in engine system 100, provides excellent homogenization of the exhaust gas into the intake air charge. Further, the disposition of EGR take-off and mixing points provides effective cooling of the exhaust gas for increased available EGR mass and increased performance. In other embodiments, the EGR system may be a high pressure EGR system with EGR passage 151 connecting from upstream of the turbine 16 to downstream of the compressor 14. In some embodiments, the MCT sensor 23 may be positioned to determine the manifold charge temperature, and may include air and exhaust recirculated through the EGR passage 151.

The water injection system 60 includes a water storage tank 63, a water pump 62, a collection system 72, and a water filling passage 69. In embodiments that include multiple injectors, water passage 61 may contain one or more valves to select between different water injectors. For example, as shown in FIG. 1, water stored in water tank 63 is delivered to water injectors 45-48 via a common water passage 61 that branches to water passages 90, 92, 94, and 96 In the depicted embodiment, water from water passage 61 may be diverted through one or more of valve 91 and passage 90 to deliver water to injector 45, through valve 93 and passage 92 to deliver water to injector 46, through valve 95 and passage 94 to deliver water to injector 48, and/or through valve 97 and passage 96 to deliver water to injector 47. Additionally, embodiments that include multiple injectors may include a plurality of temperature sensors 25 proximate to each injector to determine engine temperature at one or more water injectors. Water pump 62 may be operated by a controller 12 to provide water to water injectors 45-48 via passage 61. In an alternate embodiment, the water injection system 60 may include multiple water pumps. For example, the water injection system 60 may include a first water pump 62 to pump water to a subset of injectors (such as injectors 45 and/or 46) and a second water pump (not shown) to pump water to another subset of injectors (such as injectors 48 and/or 47. In this example, the second water pump may be a higher pressure water pump and the first water pump may be a relatively lower pressure water pump. In addition, the injection system may comprise a self-pressurized piston pump which can perform both high pressure pumping and injection. For example, one or more of the injectors may include or be coupled to a self-pressurized piston pump.

Water storage tank 63 may include a water level sensor 65 and a water temperature sensor 67, which may relay information to controller 12. For example, in freezing conditions, water temperature sensor 67 detects whether the water in tank 63 is frozen or available for injection. In some embodiments, an engine coolant passage (not shown) may be thermally coupled with storage tank 63 to thaw frozen water. The level of water stored in water tank 63, as identified by water level sensor 65, may be communicated to the vehicle operator and/or used to adjust engine operation. For example, a water gauge or indication on a vehicle instrument panel (not shown) may be used to communicate the level of water. In another example, the level of water in water tank 63 may be used to determine whether sufficient water for injection is available, as described below with reference to FIG. 5. In the depicted embodiment, water storage tank 63 may be manually refilled via water filling passage 69 and/or refilled automatically by the collection system 72 via water tank filling passage 76. Collection system 72 may be coupled to one or more components 74 that refill the water storage tank with condensate collected from various engine or vehicle systems. In one example, collection system 72 may be coupled with an EGR system to collect water condensed from exhaust passing through the EGR system. In another example, collection system 72 may be coupled with an air conditioning system (not shown). Manual filling passage 69 may be fluidically coupled to a filter 68, which may remove small impurities contained in the water that could potentially damage engine components.

FIG. 1 further shows a control system 28. Control system 28 may be communicatively coupled to various components of engine system 100 to carry out the control routines and actions described herein. For example, as shown in FIG. 1, control system 28 may include an electronic digital controller 12. Controller 12 may be a microcomputer, including a microprocessor unit, input/output ports, an electronic storage medium for executable programs and calibration values, random access memory, keep alive memory, and a data bus. As depicted, controller 12 may receive input from a plurality of sensors 30, which may include user inputs and/or sensors (such as transmission gear position, gas pedal input (e.g., pedal position), brake input, transmission selector position, vehicle speed, engine speed, mass airflow through the engine, boost pressure, ambient temperature, ambient humidity, intake air temperature, fan speed, etc.), cooling system sensors (such as ECT sensor, fan speed, passenger compartment temperature, ambient humidity, etc.), CAC 18 sensors (such as CAC inlet air temperature, ACT sensor 125 and pressure, CAC outlet air temperature, MCT sensor 23, and pressure, etc.), knock sensors 183 for determining ignition of end gases and/or water distribution among cylinders, and others. Furthermore, controller 12 may communicate with various actuators 32, which may include engine actuators (such as fuel injectors, an electronically controlled intake air throttle plate, spark plugs, water injectors, etc.). In some examples, the storage medium may be programmed with computer readable data representing instructions executable by the processor for performing the methods described below as well as other variants that are anticipated but not specifically listed.

The controller 12 receives signals from the various sensors of FIG. 1 and employs the various actuators of FIG. 1 to adjust engine operation based on the received signals and instructions stored on a memory of the controller. For example, injecting water to the engine may include adjusting an actuator of injector 45, injector 46, injector 47, and/or injector 48 to inject water and adjusting water injection may include adjusting an amount or timing of water injected via the injector. In another example, adjusting spark timing based on water injection estimates (as described further below) may include adjusting an actuator of a spark plug 184.

FIGS. 2-4 show different embodiments of an engine and example placements of water injectors within the engine. The engines 200, 300, and 400 shown in FIGS. 2-4 may have similar elements to engine 10 shown in FIG. 1 and may be included in an engine system, such as engine system 100 shown in FIG. 1. As such, similar components in FIGS. 2-4 to those of FIG. 1 are not re-described below for the sake of brevity.

A first embodiment of a water injector arrangement for an engine 200 is depicted in FIG. 2 in which water injectors 233 and 234 are positioned downstream of where an intake passage 221 branches to different cylinder groups. Specifically, engine 200 is a V-engine with a first cylinder bank 261 including a first group of cylinders 281 and a second cylinder bank 260 including a second group of cylinders 280. The intake passage branches from a common intake manifold 222 to a first manifold 245 coupled to intake runners 265 of the first group of cylinders 281 and to a second manifold 246 coupled to intake runners 264 of the second group of cylinders 280. Thus, intake manifold 222 is located upstream of all the cylinders 281 and cylinders 280. Further, throttle valve 220 is coupled to intake manifold 222. Manifold charge temperature (MCT) sensors 224 and 225 may be included downstream of the branch point in the first manifold 245 and second manifold 246, respectively, to measure the temperature of intake air at their respective manifolds. For example, as shown in FIG. 2, MCT sensor 224 is positioned within first manifold 245, proximate to water injector 233, and MCT sensor 225 is positioned within second manifold 246, proximate to water injector 234.

Each of cylinders 281 and cylinders 280 include a fuel injector 279 (as shown in FIG. 2 coupled to one representative cylinder). Each of cylinders 281 and cylinders 280 may further include a knock sensor 283 for identifying abnormal combustion events. Additionally, as described further below, comparing the outputs of each knock sensor in a cylinder group may enable a determination of maldistribution of water between cylinders of that cylinder group. For example, comparing outputs of knock sensors 283 coupled to each of cylinders 281 may allow a controller of the engine to determine how much water from injector 233 was received by each of cylinders 281. Due to the intake runners 265 being arranged at different lengths to the injector 233 and different conditions of each intake runner (e.g., airflow levels and pressure), water may not be evenly distributed to each of the cylinders 281 following an injection from injector 233.

Water may be delivered to water injectors 233 and 234 by a water injection system (not shown), like water injection system 60 described above with reference to FIG. 1. Furthermore, a controller, such as controller 12 of FIG. 1, may control injection of water into injectors 233 and 234 individually based on operating conditions of the individual manifolds that the injectors are coupled to. For example, in some examples, MCT sensor 224 may also include a pressure and/or airflow sensor for estimating an airflow rate (or amount) of airflow at the first manifold 245 and a pressure in the first manifold 245. Similarly, MCT sensor 225 may also include a pressure and/or airflow sensor for estimating an airflow rate and/or pressure at the second manifold 246. In this way, each injector 233 and 234 may be actuated to inject a different amount of water based on conditions of the manifold and/or cylinder group the injector is coupled to. A method for determining a water injection amount is discussed further below with reference to FIG. 7.

In FIG. 3, a second embodiment of a water injector arrangement for an engine 300 is shown. Engine 300 is an in-line engine where a common intake manifold 322, coupled downstream of a throttle valve 320 of a common intake passage, branches into a first manifold 345 of a first group of cylinders including cylinders 380 and 381 and a second manifold 346 of a second group of cylinders including cylinders 390 and 391. The first manifold 345 is coupled to intake runners 365 of a first cylinder 380 and third cylinder 381. The second manifold 346 is coupled to intake runners 364 of a second cylinder 390 and fourth cylinder 391. A first water injector 333 is coupled in the first manifold 345, upstream of cylinders 380 and 381. A second water injector 334 is coupled in the second manifold 346, upstream of cylinder 390 and 391. As such, water injectors 333 and 334 are positioned downstream of the branch point from the intake manifold 322. Manifold charge temperature (MCT) sensors 324 and 325 may be included in first manifold 345 and second manifold 346, proximate to the first water injector 333 and second water injector 334, respectively.

Each of the cylinders includes a fuel injector 379 (one representative fuel injector shown in FIG. 2). Each cylinder may further include a knock sensor 383 for identifying abnormal combustion events and/or a distribution of water among the cylinders in a cylinder group. Water injectors 333 and 334 may be coupled to a water injection system (not shown), like water injection system 60 described in FIG. 1.

In this way, FIGS. 2 and 3 shows examples of an engine where multiple water injectors are used to inject water to different groups of cylinders of the engine. For example, a first water injector may inject water upstream of a first group of cylinders and a second water injector may inject water upstream of a different, second group of cylinders. As discussed further below, different water injection parameters (such as water injection amount, timing, pulsing rate, etc.) may be selected for each water injector based on operating conditions of the group of cylinders the injector is coupled upstream from (such as airflow amount, pressure, firing order, etc.).

A third embodiment of a water injector arrangement for an engine 400 is depicted in FIG. 4. As in the previous embodiments, in the embodiment of FIG. 4, intake manifold 422 is configured to supply intake air or an air-fuel mixture to plurality of cylinders 480 through a series of intake valves (not shown) and intake runners 465 Each of cylinders 480 includes a fuel injector 479 coupled thereto. Each cylinder 480 may further include a knock sensor 483 for identifying abnormal combustion events and/or determining a distribution of water injected upstream of the cylinders. In the depicted embodiment, water injectors 433 are directly coupled to the cylinders 480 and thus are configured to inject water directly into the cylinders. As shown in FIG. 4, one water injector 433 is coupled to each cylinder 480. In another embodiment, water injectors may be additionally or alternatively positioned upstream of the cylinders 480 in the intake runners 465 and not coupled to each cylinder. Water may be delivered to water injectors 433 by a water injection system (not shown), like water injection system 60 described in FIG. 1.

In this way, the systems of FIGS. 1-4 present example systems that may be used to inject water into one or more locations in an engine intake or cylinders of an engine. As introduced above, water injection may be used to reduce a temperature of the intake air entering engine cylinders and thereby reduce knock and increase volumetric efficiency of the engine. Injecting water may also be used to increase engine dilution and thereby reduce engine pumping losses. As explained above, water may be injected into the engine at different locations, including the intake manifold (upstream of all engine cylinders), manifolds of groups of cylinders (upstream of a group of cylinders, such as in a V-engine), intake runners or ports of engine cylinders, or directly into engine cylinders. While direct and port injection may provide increased cooling to the engine cylinders and ports, intake manifold injection may increase cooling of the charge air without needing high pressure injectors and pumps (such as those that may be needed for port or direct cylinder injection). However, due to the lower temperature of the intake manifold (as it is further away from the cylinders), not all the water injected at the intake manifold may atomize (e.g., vaporize) properly. In some examples, as shown in FIG. 1, engines may include injectors at multiple locations within the engine intake or engine cylinders. Under different engine load and/or speed conditions it may be advantageous to inject water at one location over another to achieve increased charge air cooling (intake manifold) or dilution (cylinder intake ports/runners). In this way, selecting a location for water injection based on engine operating conditions (as shown in the methods presented at FIGS. 5-6 and described further below) may increase the water injection benefits described above, thereby increasing engine efficiency, increasing fuel economy, and decreasing emissions.

In some cases, after injecting water, a first portion of the injected water may vaporize and a remaining, second portion may condense (or stay liquid within the intake manifold or injector location). Condensed water from water injection may accumulate within the intake manifold and result in unstable combustion if ingested by the engine. Additionally, the ratio of vaporized to condensed water may change the amount of charge air cooling provided. Thus, as explained further below with reference to FIG. 7-8, subsequent water injection parameters (e.g., injection amounts and/or timing) and/or engine operating conditions (such as airflow amount/rate to the engine and spark timing) may be adjusted in response to an estimate of the vaporized and condensed portions of water injected. For example, engine operating parameter adjustments may compensate for increased amounts of injected water that remains liquid instead of vaporizing.

Additionally, as introduced above, an engine may include multiple water injectors, where each water injector injects water upstream of a different group of cylinders. In this case, water injection parameters for each injector may be individually determined based on conditions of the group of cylinders that the injector is coupled to (e.g., airflow to the group of cylinders, pressure upstream of the group of cylinders, etc.). Further, manifold water injection upstream of a group of cylinders (e.g., two or more cylinders) may result in uneven water distribution amongst the cylinders of the group due to differences in architecture or conditions (e.g., pressure, temperature, airflow, etc.) of the individual cylinders in the group. As a result, uneven cooling may be provided to the engine cylinders. In some examples, as explained further below with reference to FIG. 8, maldistribution of water injected upstream of a group of cylinders may be detected and compensated for in response to a comparison of outputs of knock sensors coupled to each cylinder of the group.

Turning to FIG. 5, an example method 500 for injecting water into an engine is depicted. Injecting water may include injecting water via one or more water injectors of a water injection system, such as the water injection system 60 shown in FIG. 1. Instructions for carrying out method 500 and the rest of the methods included herein may be executed by a controller (such as controller 12 shown in FIG. 1) based on instructions stored on a memory of the controller and in conjunction with signals received from sensors of the engine system, such as the sensors described above with reference to FIG. 1, 2, 3, or 4. The controller may employ engine actuators of the engine system to adjust engine operation, according to the methods described below. In one example, water may be injected via one or more water injectors using a water injection system (such as water injection system 60 shown in FIG. 1).

The method 500 begins at 502 by estimating and/or measuring engine operating conditions. Engine operating conditions may include manifold pressure (MAP), air-fuel ratio (A/F), spark timing, fuel injection amount or timing, an exhaust gas recirculation (EGR) rate, mass air flow (MAF), manifold charge temperature (MCT), engine speed and/or load, etc. Next, at 504, the method includes determining whether water injection has been requested. In one example, water injection may be requested in response to a manifold temperature being greater than a threshold level. Additionally, water injection may be requested when a threshold engine speed or load is reached. In yet another example, water injection may be requested based on an engine knock level being above a threshold. Further, water injection may be requested in response to an exhaust gas temperature above a threshold temperature, where the threshold temperature is a temperature above which degradation of engine components downstream of cylinders may occur. In addition, water may be injected when the inferred octane number of used fuel is below a threshold.

If water injection has not been requested, engine operation continues at 506 without injecting water. Alternatively, if water injection has been requested the method continues at 508 to estimate and/or measure water availability for injection. Water availability for injection may be determined based on the output of a plurality of sensors, such as water level sensor and/or water temperature sensor disposed in a water storage tank of a water injection system of the engine (such as water level sensor 65 and water temperature sensor 67 shown in FIG. 1). For example, water in the water storage tank may be unavailable for injection in freezing conditions (e.g., when the water temperature in the tank is below a threshold level, where the threshold level is at or near a freezing temperature). In another example, the level of water in the water storage tank may be below a threshold level, where the threshold level is based on an amount of water required for an injection event or a period of injection cycles. In response to the water level of the water storage tank being below the threshold level, refilling of the tank may be indicated. If water is not available for injection, the method continues at 512 to adjust engine operating parameters without injecting water. For example, if water injection has been requested to reduce knock, engine operation adjustments may include enriching the air-fuel ratio, reducing an amount of throttle opening to decrease manifold pressure, retarding spark timing, etc. However, if water is available for injection, the method continues at 514 to determine whether the engine includes multiple injector locations. Multiple injector locations may include water injectors being positioned at more than one type of location in an engine. For example, an engine may include two types of water injectors: an intake manifold water injector and port water injectors in the intake runners/ports of each cylinder. If the engine does not have multiple water injector locations, the method continues at 518 to inject water via one or more water injectors. For example, the method at 518 may include injecting water via the single type of water injectors of the engine (e.g., via a single intake manifold water injector, manifold water injectors of a manifold for each group of cylinders, port water injectors, or direct cylinder water injectors). Additionally, at 518, subsequent water injection and engine operating conditions are adjusted in response to the estimated amount of injected water that has condensed, as described below in reference to FIG. 7. However, if multiple types of injectors are present in the engine, the method first continues at 516 to select the type of water injectors for water injection, as discussed further below with reference to FIG. 6, before continuing to 518 to inject water and adjust engine operation.

FIG. 6 depicts a method 600 for selecting a location for water injection based on engine operating conditions. As explained above, an engine may include water injectors positioned in one or more locations including: an intake manifold (either upstream or downstream of an intake throttle), an intake port of each engine cylinder, and/or in each cylinder. Method 600 may be executed by a controller of an engine including water injectors in each of the intake manifold, cylinder intake ports (e.g., intake runners), and the cylinders themselves (e.g., in the combustion chambers). FIG. 1 shows an example engine including such a combination of injector locations. Method 600 may continue from the method at 516 of method 500.

The method 600 starts at 602 by determining whether engine speed and/or load is greater than a threshold. In one example, the threshold may be indicative of a relatively high load and/or engine speed at which engine knock may be more likely to occur. If engine speed and/or load are greater than the respective thresholds, the method continues at 604 where the intake manifold injector(s) are selected for water injection. In one example, the engine may include a single intake manifold and thus a single intake manifold water injector (such as injector 45 or 46 shown in FIG. 1). In another example, the engine may include multiple manifolds, each upstream of different group of cylinders, and thus include multiple manifold water injectors (such as injectors 233 and 234 shown in FIG. 2 or injectors 333 and 334 shown in FIG. 3). Next, at 606, the method includes assessing whether an upper threshold for manifold injection has been reached. In one example, the upper threshold for manifold injection may include a maximum amount of water that may be injected at the manifold for the current engine operating conditions (e.g., current humidity, pressure, temperature). For example, only a certain amount of water may be able to vaporize and become entrained in the airflow in the intake manifold. Thus, additional water injected above this upper threshold may not provide any additional benefits (e.g., such as additional charge air cooling). If manifold injection is at or above the upper threshold, direct injectors (adapted to inject water directly into engine cylinders) are additionally selected at 610 and water is injected at 612 using both the manifold injector(s) and the cylinder direct injectors. If manifold injection is not at the upper threshold, then water is injected at 612 using the manifold injector(s) only. Returning to 602, if engine speed and/or load is less than the threshold, then at 608 the port water injectors are selected and water is injected into the intake ports of the cylinders at 612. The method at 612 may return to 518 of method 500 to inject water and then adjust engine operation based on estimates of vaporized and condensed portions of the injected water, as shown at FIG. 7.

FIG. 7 illustrates a method 700 for estimating the amount of water vaporized and condensed following water injection. Method 700 continues from and may be part of the method at 518 of FIG. 5. It should be noted that method 700 may be repeated for each injector that injects water (e.g., each manifold, port, or direct injector). In this way, the estimated amount of water that vaporized and condensed from water injection at each injector may be determined for each individual injector.

The method 700 starts at 702 by determining the amount of water to inject at the selected water injectors following a water injection request. The amount of water for injection may be based on feedback from a plurality of sensors, which provide information about various engine operating parameters. These parameters may include engine speed and load, spark timing, ambient conditions (e.g., ambient temperature and humidity), a fuel injection amount and/or knock history (based on the output of knock sensors coupled to or near the engine cylinders). In one example, the water injection amount may increase as engine load increases. Additionally, at 702 the method includes measuring a manifold charge temperature of an intake manifold (e.g., monitoring an output of a MCT sensor, such as MCT 23 shown in FIG. 1). In another example, if the water injectors are not located in the intake manifold, the method at 702 may include measuring the charge air temperature proximate to the selected water injector (such as sensor 324 proximate to injector 333 in FIG. 3 or sensor 25 proximate to injector 48 in FIG. 1). In yet another example, the temperature of the charge air proximate to the water injectors (such as direct injectors at the engine cylinders) may be estimated based on one or more engine operating conditions (such as measured intake and exhaust air temperatures, engine load, knock intensity signal, etc.).

At 704, water is injected at selected injectors as described above with reference to method 600 shown in FIG. 6. Following water injection, at 706, the method includes measuring the manifold charge temperature again after a duration. In another embodiment, the method at 706 may additionally or alternatively include measuring or estimating the temperature proximate to the selected injector following the water injection event at 704. The duration between a water injection event and measuring manifold charge temperature may be based on an amount of time for the injected amount of water to vaporize and/or condense. Thus, this duration may be adjusted relative to the amount of water injected. In one example, the duration may increase as the amount of water injected at the injector increases. In another example, the duration may be adjusted base on the measured or estimated manifold charge temperature. Based on the change in manifold charge temperature measured from before water injection, at 702, and after, at 706, the amount of the injected water that vaporized may be estimated at 708. Said another way, a vaporized portion of the injected water may be determined at 708 based on the change in manifold (or other location of the injector) charge air temperature from before to after the water injection event.

Next, at 710, the method includes estimating the amount (e.g., portion) of the injected water that condensed (e.g., remained liquid) based on the amount of water injected via the selected injector and the estimated amount of water that vaporized, as determined at 708. For example, the amount of water of the injected water that condensed may be a remaining portion of water from the vaporized portion. Then, at 712, the method includes determining whether the vaporized portion of water is greater than a threshold. The threshold vaporized portion may be a non-zero value and may also be less than 100% of the water injected. In one example, the threshold may be 90% of the amount of water injected. However, in other examples the threshold value may be 100% or some value between 60 and 100%. If the vaporized portion following water injection is above the threshold, at 716 the method includes continuing engine operation at the current operating parameters. For example, the method at 716 may include continuing to inject the previously injected amount of water at the selected injector(s), without adjusting the amount of water for injection.

However, if the vaporized portion is not greater than the threshold, at 714 the method may include adjusting engine operating parameters based on the determined vaporized and/or condensed portions. In one example, when the engine includes multiple groups of cylinders with one injector coupled to and upstream of each group, engine operation may also be adjusted based on the vaporized and condensed portions of other groups, as well as a determined distribution of injected water to cylinders within a group, as described further below in reference to FIG. 8. In one example, at 713, the method may include adjusting one or more engine operating parameters based on the determined condensed portion of injected water. As one example, adjusting one or more engine operating parameters at 713 may include adjusting spark timing to compensate for the condensed portion of the injected water. For example, adjusting spark timing may include increasing an amount of spark advance, where the amount of spark advance increases as the condensed portion decreases (or the vaporized portion increases). In another example at 713, the method may include adjusting a fuel injection amount based on the determined vaporized and/or condensed portions. In yet another example, the method at 713 may include adjusting one or more engine operating parameters to increase airflow to the engine cylinders to purge the condensed portion of injected water from the intake manifold (or intake runners if that's where the selected injector is located). Adjusting one or more engine operating parameters to increase airflow to the engine cylinders may include increasing an opening of a throttle valve and/or adjusting a transmission gear to increase engine speed. The amount of increase in airflow at 713 may be based on the determined condensed portion (e.g., the amount of airflow increase may increase further as the condensed portion increases). In some examples, purging the condensed portion in this way may only proceed when the engine is able to handle the water (e.g., during deceleration fuel shut-off conditions). In yet another example, the method at 714 may include advancing spark at the same time as increasing airflow to purge the condensed portion. In one example, at 715, the method includes adjusting the amount of water and/or timing delivered by the selected water injector(s) for subsequent injections based on the vaporized portion. For example, at 715 the method may include decreasing the amount of water for the next injection in response to an increased amount of condensate present (e.g., as the condensed portion increases and the vaporized portion decreases). Adjusting water injection at 715 may differ depending on the injectors present in an embodiment, as well as which injectors are selected for water injection. For example, where multiple injectors are present, with a single water injector coupled to or upstream of each cylinder, water injection amount may be adjusted for each water injector. In another embodiment, where one or more injectors are located upstream of multiple cylinders or a group of cylinders, injection timing of the selected water injector may be synced with intake valve opening timing of that cylinder to adjust water injection to particular cylinders, as described further below with reference to FIG. 8.

In FIG. 8, a method 800 for injecting water at different groups of cylinders of an engine and adjusting water injection parameters based on a distribution of water injected upstream of a group of cylinders is shown. In one embodiment, an engine may include multiple groups of cylinders with one injector coupled to and upstream of each group (such as in engine 200 shown in FIG. 2 and engine 300 shown in FIG. 3). As introduced above and discussed further below, water injected upstream of a first cylinder group may influence the amount of water or vapor received at the second cylinder group. Additionally, due to differences in architecture of the intake runners of cylinders within a cylinder group, maldistribution of water amongst the cylinders of one group may occur.

The method 800 starts at 801 by determining injection parameters for each injector of each cylinder group. Injection parameters may include an amount of water and timing of each injection event. For example, the method at 801 may include determining a first injection amount to inject at a first injector upstream of a first group of cylinders and determining a second injection amount to inject at a second injector upstream of a second group of cylinders. The first and second amounts may be individually determined based on operating conditions of the first and second groups of cylinders (e.g., airflow level or mass air flow to the corresponding group of cylinders, pressure at the corresponding group of cylinders, temperature of the corresponding group of cylinders, a knock level at the corresponding group of cylinders, a fuel injection amount at the corresponding group of cylinders, etc.). In one example, the injector may deliver the amount of water as a single pulse per engine cycle (for all intake valve opening events for all cylinders of the group). In another example, the injector may deliver the amount of water as a series of pulses timed to the intake valve opening of each cylinder within the cylinder group. In this example, the method at 801 may include determining the amount of water to deliver during each pulse for each cylinder within the group (or determining a total water injection amount for all cylinders and dividing by the number of cylinders within the group) and determining the timing of each pulse based on the intake valve opening timing of each cylinder within the group. In some embodiments, the initial amount and timing of the water injection pulses may be determined based on engine mapping of the cylinders. For example, each engine may have a different cylinder and intake runner architecture (e.g., geometry) that results in a difference in water distribution to each cylinder of a group from a same water injector. For example, each cylinder of the group of cylinders may be a different distance away from the water injector coupled to the group of cylinders and/or each intake runner may have a different shape or curvature that affects how the injected water is delivered to the corresponding cylinder. Further, the angle of the injector relative to each cylinder may be different within the group of cylinders. Thus, an initial pulsed injection timing and amount of water delivered for each pulse (which may be different for different cylinders within the group) may be determined based on a known architecture of the engine. This pulse timing may then be adjusted during engine operation based on operating conditions of the cylinders, as discussed further below.

The method continues at 802 by determining the vaporized and condensed portions of water injected by each injector for each cylinder or cylinder group. This may include measuring manifold charge temperature before and after an injection event, as previously described for method 700 in FIG. 7, and using the change in temperature to estimate the vaporized and condensed portions of injected water. Then, at 804 the method includes adjusting the estimated vaporized and condensed portions for the cylinders downstream of each injector based on the estimates from the other groups. For example, a first injector may inject a first amount of water upstream of a first group of cylinders and a second injector may inject a second amount of water upstream of a different, second group of cylinders. The estimated vaporized and condensed portions of the first amount may be adjusted based on the estimated vaporized and condensed portions of the second amount (and vice versa). For example, as the condensed portion of the first amount increases, the controller may increase the estimate of the condensed portion of the second amount. This may be due to a predicted amount of cross-talk or puddle communication/sharing between the cylinder groups (e.g., due to proximity of the branch points between the cylinder groups and airflow amounts to each cylinder group. Thus, an expected amount of condensed water sharing may occur between the cylinder groups under certain conditions.

Next, at 806, the method includes obtaining knock sensor outputs from each cylinder in a cylinder group (such as from knock sensors 283, 383, or 483 shown in FIGS. 2-4) and determining maldistribution of water to the cylinders within each cylinder group based on the outputs. For example, as introduced above, intake manifold runner architecture may inherently result in uneven distribution of water from an injector to cylinders in a group. In another example, maldistribution of water may occur due to differences in the angle of the water injector upstream of the group of cylinders relative to each runner.

Based on the assessed water maldistribution at 806, at 808 the method includes determining whether a water imbalance is detected for a group of cylinders. As one example, water maldistribution (e.g., water imbalance) among a group of cylinders coupled to a water injector may be determined based on a comparison of knock outputs of knock sensors coupled to each cylinder in the group. For example, the knock output may be used to determine differences in knock intensity in individual cylinders relative to other cylinders in the group. If the change in knock intensity following water injection is different for one or more cylinders in a group compared to the others, this may indicate differences in water distribution. For example, a standard deviation in knock outputs corresponding to different cylinders may be determined and if the standard deviation is greater than a threshold standard deviation value, water imbalance may be indicated. In yet another example, if a knock output corresponding to an individual cylinder differs from an average value of all knock outputs corresponding to all cylinders of the group, by a threshold amount, the individual cylinder may be indicated as receiving more or less water than the other cylinders in the group. In another example, water maldistribution among a group of cylinders coupled to a water injector may be determined based on differences in spark retard in individual cylinders from an expected amount, the expected amount based on engine mapping. If water imbalance is not detected, then the method proceeds to 810 where a subsequent water injection amount for the cylinder groups is adjusted based on the adjusted vaporized and condensed portions (and not the knock sensor outputs) determined at 804 of the method. However, if a water imbalance is detected, the method continues at 812 to adjust the injection amount, pulse rate, and/or timing of water injected by the water injector of the group of cylinders based on the determined maldistribution (e.g., knock sensor outputs) and/or the adjusted vaporized and condensed portions. In one example of the method at 812, the controller may increase the amount of water injected for a pulse that corresponds to the intake valve opening of a cylinder to compensate for less water detected at that cylinder than others. The lower amount of water detected at the one cylinder relative to the others in the group may be based on the knock sensor output from that cylinder being higher than the other cylinders. In another example of the method at 812, the controller may decrease water injection to a group of cylinders based on determining that the vaporized portion of water injected is less than a threshold. Next, the method continues at 814 to adjust engine operation for each group of cylinders in response to the detected water imbalance at 808 and/or the adjusted vaporized and condensed portions determined at 804. The method at 814 may be similar to the method at 714, as described above. Additionally, in one example, the method at 814 may include, if spark timing is retarded, advancing spark timing differently amongst a group of cylinders based on the detected water imbalance.

In FIG. 9, graph 900 illustrates adjustments to engine operation based on estimated vaporized and condensed portions of water injected via a water injector. For example, graph 900 illustrates adjustments to an amount of water injected from a water injector of a water injection system (such as water injection system 60 shown in FIG. 1), based on manifold charge temperature sensor output, as well as adjustments to engine operating conditions, such as spark timing following a water injection. Specifically, the operating parameters illustrated in graph 900 show an amount of water injected via a water injector at 902, changes in an output of a manifold charge temperature sensor at plot 904, an estimated portion of injected water that evaporated at plot 906, an estimated portion of injected water that condensed at plot 908, and changes in spark timing at plot 910. For each operating parameter, time is depicted along the horizontal axis and values of each respective operating parameter are depicted along the vertical axis. In one example, the manifold charge temperature sensor may be positioned proximate to the water injector, such as within the intake manifold if the water injector is positioned in the intake manifold.

Prior to time t1, manifold temperature increases (plot 904) and water injection may be requested based on engine operation. For example, water injection may be requested due to engine load being greater than a threshold. In another example, water injection may be requested in response to an indication of knock. At time t1, in response to an indication of knock the controller may initially retard spark timing from MBT (plot 910).

In response to the injection request, the manifold charge temperature may be measured and the controller commands an amount of water to be injected (plot 902) from the water injection system at time t1. As a result, manifold charge temperature decreases from time t1 to t2 (plot 904). After a duration following injection at t2, manifold charge temperature is measured again. The duration between a water injection and measuring manifold charge temperature may be adjusted in response to the amount of water injected or other engine operating conditions. From the measured change in manifold charge temperature and the amount of water injected, a vaporized, first portion of the injected water (plot 906) and a condensed, second portion that remains in the manifold (plot 908) are estimated at time t2. For example, spark timing from MBT (plot 910) may advance in response to the vaporized portion of the injected water, and then, in response determining that the vaporized portion of water is greater than the threshold, the controller may maintain spark timing from MBT at time t2.

At a later time t3, water injection is requested and the controller commands an adjusted amount of water to be injected based on a previous injection. For example, in response to a vaporized portion above a threshold from a previous injection at time t2, the amount of water injected at time t3 may be increased from the amount injected at time t1. Following the water injection at time t3, at time t4, the vaporized portion is less than the threshold (plot 906). At time t4, in response to determining that the vaporized portion of water is less than a non-zero threshold, the controller may adjust engine operating parameters, such as spark timing from MBT (plot 910) based on the condensed portion (plot 908). For example, spark may be advanced in response to a vaporized portion; however, the amount of spark advance at time t4 may be less than at time t2 to compensate for an increased amount of liquid water from the water injection and an increased knock tendency. In this way, the amount of spark advance following a water injection event decreases with a decreased vaporized portion and increased condensed portion.

At time t5, water injection is again requested. The amount of water injected (plot 902) at time t5 may be determined based on the vaporized and condensed portions from the previous water injection. Between time t5 and t6, the vaporized portion of injected water is above the threshold. In response to the vaporized portion above the threshold at time t6, the controller may maintain current operating conditions and advance spark timing.

Figure 10:
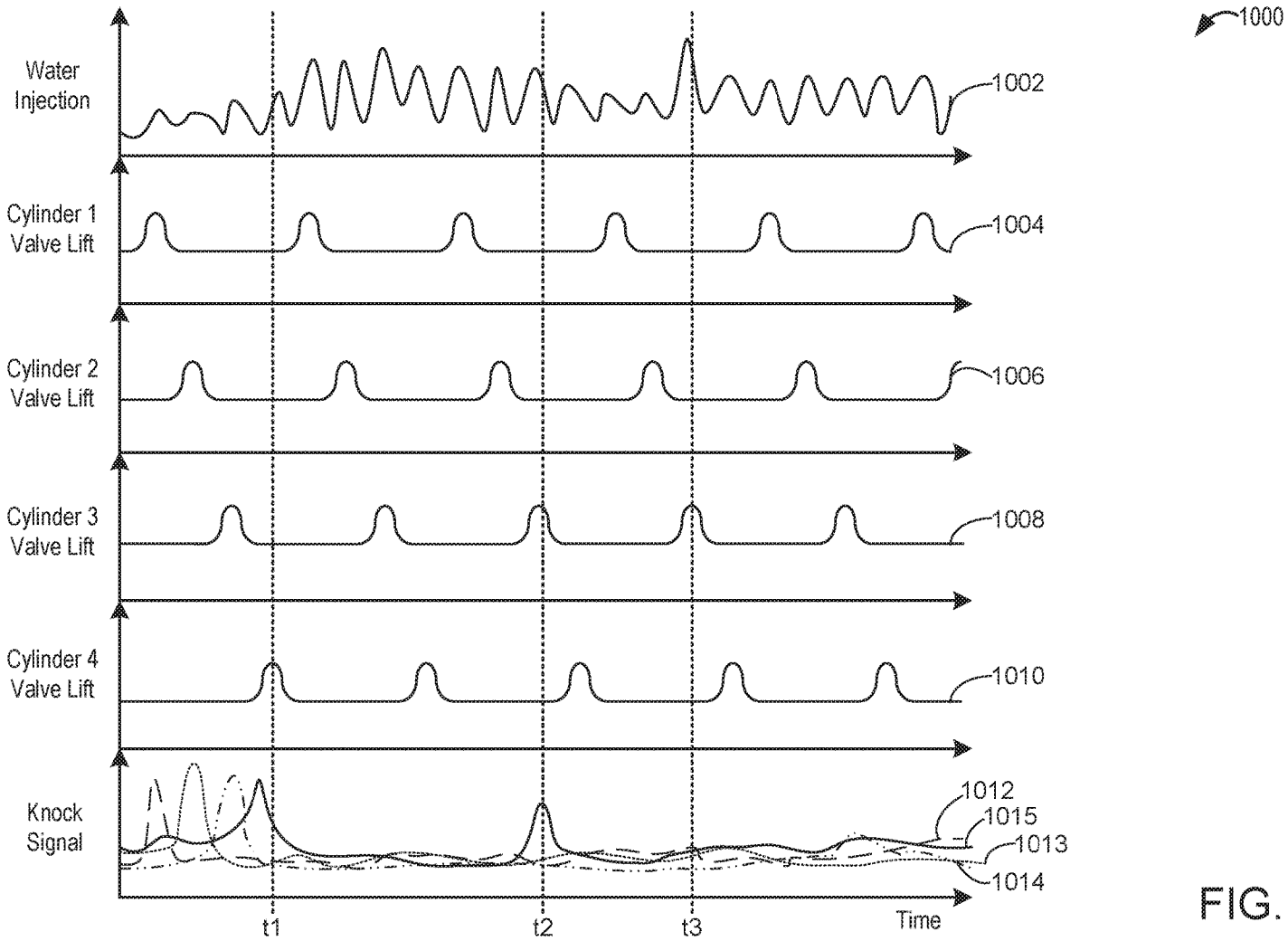
FIG. 10 shows a graph depicting adjustments to a water injection amount and timing based on an indicated distribution of water to a group of cylinders.

In FIG. 10, graph 1000 illustrates adjustments to a water injector injection amount and timing in response to uneven distribution of injected water across a group of cylinders coupled to the injector. The operating parameters illustrated in graph 1000 include water injection at plot 1002, cylinder valve lift for each of four cylinders at 1004-1010, and knock signals (e.g., knock output of a knock sensor) for each of four cylinders at 1012-1015. (A dashed line corresponds to the knock output of a knock sensor coupled to cylinder 1 (plot 1012); a dotted line corresponds to the knock output of a knock sensor coupled to cylinder 2 (plot 1013); a dash-dot line corresponds to the knock output of a knock sensor coupled to cylinder 3 (plot 1014), and a solid line corresponds to the knock output of a knock sensor coupled to cylinder 4 (plot 1015)). In the depicted example, water injection pulses are synced with the valve lift for each cylinder. Additionally, in this example, water may be injected upstream of all of cylinders 1-4 (such as via a manifold injector positioned in an intake manifold upstream of all of cylinders 1-4). For each operating parameter, time is depicted along the horizontal axis and values of each respective operating parameter are depicted along the vertical axis.

Prior to time t1, water is injected upstream of each cylinder (e.g., in the intake manifold) in response to a water injection request and knock signal intensity is monitored. As explained above. The water may be injected by pulsing the injector at times synced to the intake valve opening of each cylinder. In this way, multiple pulses of water may be delivered by a single injector positioned upstream of cylinders 1-4. Knock signal intensity increases prior to time t1 due to engine operating conditions. In response to feedback about engine operation from a plurality of sensors, including knock sensors, the controller may increase the amount of water injected for each pulse at time t1. Between time t1 and t2, knock intensity signal may decrease due to increased water injection. Thus, the controller may continue current engine operation and water injection amount and pulsing. At a later time t2, knock intensity signal increases for cylinder 3. This may occur as a result of uneven water distribution from the water injector to cylinder 3 relative to the other cylinders in the group (e.g., cylinders 1, 2, and 4). In response to detecting that cylinder 3 has an increased knock signal and may have received less water (relative to the other cylinders in the group), the controller may increase the water injected to cylinder 3 at time t3. By increasing the amount of water injected for a pulse that corresponds to valve lift for cylinder three, more water can be delivered to a particular cylinder even though an injector may be upstream of a group of cylinders. After time t3, the controller may continue water injection pulses responsive to engine operating conditions and previous injections.

In this way, engine operation and an amount of water injected may be adjusted based on a first portion of an amount of water that vaporized and a second portion that remain liquid during a water injection event. In one example, the amount of water that vaporized may be determined based on a change in manifold charge temperature before and after an injection and the amount of water that remained liquid (e.g. condensed) may be determined based on the vaporized portion and the amount of water injected. As a result, water injection and engine operation may be adjusted to compensate for the vaporized and condensed portions. As one example, water injection amounts for subsequent water injection events may be adjusted based on the vaporized and/or condensed portions. In another example, engine operating parameters such as spark timing may be adjusted in response to the first and second portions. By adjusting water injection and engine operating conditions responsive to the vaporized and condensed portions, the likelihood of unstable combustion due to condensed liquid in the intake manifold is decreased. Additionally, the fuel economy and engine performance benefits of water injection may be increased. The technical effect of adjusting an amount of water for water injection into an engine based on a vaporized portion and a condensed portion is to compensate condensed liquid following a water injection event.

As one embodiment, a method includes injecting an amount of water into an intake manifold of an engine responsive to engine conditions; and adjusting an engine operating parameter responsive to a first portion of the amount of water that vaporized and second portion of the amount of water that remained liquid. In a first example of the method, the method further comprises determining the first portion based on a change in manifold temperature following the injecting and determining the second portion based on the injected amount of water and the first portion. A second example of the method optionally includes the first example and further includes wherein the change in manifold temperature following the injecting is a difference in manifold temperature from before the injecting to a duration after the injecting, where the duration is based on an estimated amount of time for the injected amount of water to vaporize. A third example of the method optionally includes one or more of the first and second examples, and further includes wherein adjusting the engine operating parameter includes continuing to inject the amount of water into the intake manifold, without adjusting the amount of water, in response to the determined first portion being over a threshold. A fourth example of the method optionally includes one or more of the first through third examples, and further includes wherein adjusting the engine operating parameter includes increasing an amount of spark advance in response to the determined first portion being less than a threshold, where the amount of spark advance is based on the determined second portion. A fifth example of the method optionally includes the first through fourth examples, and further includes wherein adjusting the engine operating parameter includes adjusting the amount of water injected into the intake manifold to a second amount in response to the determined first portion being less than a threshold, where the second amount is based on the determined first portion. A sixth example of the method optionally includes the first through fifth examples, and further includes wherein adjusting the engine operating parameter includes, adjusting one or more engine operating parameters to increase airflow to the engine to purge the second portion from the intake manifold in response to the determined first portion being less than a threshold, where an amount of increase in airflow to the engine is based on the determined second portion. A seventh example of the method optionally includes the first through sixth examples, and further includes wherein adjusting the engine operation parameter includes adjusting a first engine operating parameter in response to the first portion and adjusting a different, second engine operating parameter in response to the second portion. An eighth example of the method optionally includes the first through seventh examples, and further includes wherein the first engine operating parameter includes one or more of a subsequent amount of water to inject into the intake manifold and the second engine operating parameter includes one or more of spark timing and airflow to the engine to initiate a proactive condensate purging routine. A ninth example of the method optionally includes the first through eighth examples, and further comprises determining the amount of water to inject into the intake manifold based on one or more of engine load, engine speed, a fuel injection amount, indication of engine knock, spark timing, and ambient conditions. A tenth example of the method optionally includes the first through ninth examples, and further includes wherein injecting the amount of water into the intake manifold includes actuating, via a controller, a water injector coupled to the intake manifold, upstream of all engine cylinders and downstream of an intake throttle, to inject the amount of water. An eleventh example of the method optionally includes the first through tenth examples, and further comprises, at the same time as injecting the amount of water with the water injector, injecting an amount of fuel into one or more engine cylinders via one or more fuel injectors coupled to the one or more engine cylinders.

As another embodiment, a method comprises following injecting a first amount of water into an intake manifold responsive to engine conditions, determining a first portion of the first amount of water that vaporized and a remaining, second portion of the first amount of water that condensed; adjusting an engine operating parameter based on the second portion; and during a subsequent water injection event, injecting a second amount of water into the intake manifold based on the first portion. In a first example of the method, the method further includes wherein the determining the second portion includes determining the second portion based on the injected first amount and a change in manifold temperature from before to after the injecting. A second example of the method optionally includes the first example and further includes wherein the second amount is different than the first amount if the determined first portion is less than a threshold and wherein the second amount increases as the determined first portion decreases. A third example of the method optionally includes one or more of the first and second examples, and further includes wherein adjusting the engine operating parameter includes increasing an amount of opening of an intake throttle to increase airflow and purge the second portion into engine cylinders of the engine in response to the second portion increasing above a threshold and a deceleration fuel shut off event. A fourth example of the method optionally includes the first through third examples, and further includes wherein adjusting the engine operating parameter includes decreasing an amount of spark advance as the determined second portion increases.

As yet another embodiment, a system includes a water injector coupled to an intake manifold upstream of an engine cylinder; a temperature sensor coupled to the intake manifold; a controller including non-transitory memory with computer readable instructions for: injecting a first amount of water into the intake manifold via the water injector; determining a portion of the first amount that condensed within the intake manifold based on a change in manifold temperature measured by the temperature sensor following the injecting and the first amount of water; and adjusting engine operation based on the determined portion. In a first example of the system, the system further includes wherein the computer readable instructions further include instructions for adjusting the first amount of water injected into the intake manifold during a subsequent injection event based on a determined portion of the first amount that vaporized within the intake manifold, where the determined portion that vaporized is based on the change in manifold temperature. A second example of the system optionally includes the first example and further includes wherein the water injector is coupled downstream of an intake throttle and wherein the water injector is coupled to the intake manifold upstream of intake ports of a plurality of engine cylinders.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

injecting an amount of water into an intake manifold of an engine responsive to engine conditions; and adjusting an engine operating parameter responsive to a first portion of the amount of water that vaporized and second portion of the amount of water that remained liquid.

2. The method of claim 1, further comprising determining the first portion based on a change in manifold temperature following the injecting and determining the second portion based on the injected amount of water and the first portion.

3. The method of claim 2, wherein the change in manifold temperature following the injecting is a difference in manifold temperature from before the injecting to a duration after the injecting, where the duration is based on an estimated amount of time for the injected amount of water to vaporize.

4. The method of claim 2, wherein adjusting the engine operating parameter includes continuing to inject the amount of water into the intake manifold, without adjusting the amount of water, in response to the determined first portion being over a threshold.

5. The method of claim 2, wherein adjusting the engine operating parameter includes increasing an amount of spark advance in response to the determined first portion being greater than a threshold, where the amount of spark advance is based on the determined second portion.

6. The method of claim 2, wherein adjusting the engine operating parameter includes adjusting the amount of water injected into the intake manifold to a second amount in response to the determined first portion being less than a threshold, where the second amount is based on the determined first portion.

7. The method of claim 2, wherein adjusting the engine operating parameter includes, adjusting one or more engine operating parameters to increase airflow to the engine to purge the second portion from the intake manifold in response to the determined first portion being less than a threshold, where an amount of increase in airflow to the engine is based on the determined second portion.

8. The method of claim 1, wherein adjusting the engine operation parameter includes adjusting a first engine operating parameter in response to the first portion and adjusting a different, second engine operating parameter in response to the second portion.

9. The method of claim 8, wherein the first engine operating parameter includes one or more of a subsequent amount of water to inject into the intake manifold and the second engine operating parameter includes one or more of spark timing and airflow to the engine to initiate a proactive condensate purging routine.

10. The method of claim 1, further comprising determining the amount of water to inject into the intake manifold based on one or more of engine load, engine speed, a fuel injection amount, indication of engine knock, spark timing, and ambient conditions.

11. The method of claim 1, wherein injecting the amount of water into the intake manifold includes actuating, via a controller, a water injector coupled to the intake manifold, upstream of all engine cylinders and downstream of an intake throttle, to inject the amount of water.

12. The method of claim 11, further comprising, at the same time as injecting the amount of water with the water injector, injecting an amount of fuel into one or more engine cylinders via one or more fuel injectors coupled to the one or more engine cylinders.

13. A method, comprising:

following injecting a first amount of water into an intake manifold responsive to engine conditions, determining a first portion of the first amount of water that vaporized and a remaining, second portion of the first amount of water that condensed;

adjusting an engine operating parameter based on the second portion; and during a subsequent water injection event, injecting a second amount of water into the intake manifold based on the first portion.

14. The method of claim 13, wherein the determining the second portion includes determining the second portion based on the injected first amount and a change in manifold temperature from before to after the injecting.

15. The method of claim 13, wherein the second amount is different than the first amount if the determined first portion is less than a threshold and wherein the second amount increases as the determined first portion decreases.

16. The method of claim 13, wherein adjusting the engine operating parameter includes increasing an amount of opening of an intake throttle to increase airflow and purge the second portion into engine cylinders of the engine in response to the second portion increasing above a threshold and a deceleration fuel shut off event.

17. The method of claim 13, wherein adjusting the engine operating parameter includes decreasing an amount of spark advance as the determined second portion increases.

18. A system, comprising:

a water injector coupled to an intake manifold upstream of an engine cylinder;

a temperature sensor coupled to the intake manifold;

a controller including non-transitory memory with computer readable instructions for:

injecting a first amount of water into the intake manifold via the water injector;

determining a portion of the first amount that condensed within the intake manifold based on a change in manifold temperature measured by the temperature sensor following the injecting and the first amount of water; and adjusting engine operation based on the determined portion.

19. The system of claim 18, wherein the computer readable instructions further include instructions for adjusting the first amount of water injected into the intake manifold during a subsequent injection event based on a determined portion of the first amount that vaporized within the intake manifold, where the determined portion that vaporized is based on the change in manifold temperature.

20. The system of claim 18, wherein the water injector is coupled downstream of an intake throttle and wherein the water injector is coupled to the intake manifold upstream of intake ports of a plurality of engine cylinders.

* * * * *